US006363133B1

(12) United States Patent
Maeder

(10) Patent No.: US 6,363,133 B1
(45) Date of Patent: Mar. 26, 2002

(54) DEVICE FOR COUNTING OBJECTS CONVEYED IN AN OVERLAPPING ARRANGEMENT

(75) Inventor: Carl Conrad Maeder, Hinwil (CH)

(73) Assignee: Ferag AG, Hinwil (CH)

( * ) Notice: Subject to any disclaimer, the term of this patent is extended or adjusted under 35 U.S.C. 154(b) by 0 days.

(21) Appl. No.: 09/554,570

(22) PCT Filed: Dec. 29, 1998

(86) PCT No.: PCT/CH98/00558

§ 371 Date: May 16, 2000

§ 102(e) Date: May 16, 2000

(87) PCT Pub. No.: WO99/35612

PCT Pub. Date: Jul. 15, 1999

(30) Foreign Application Priority Data

Dec. 30, 1997 (CH) ..... 2983/97

(51) Int. Cl.[7] ..... G06M 7/00
(52) U.S. Cl. ..... 377/8; 271/262
(58) Field of Search ..... 377/8; 235/98 B; 271/262

(56) References Cited

U.S. PATENT DOCUMENTS

| | | | | |
|---|---|---|---|---|
| 4,713,831 A | | 12/1987 | Morisod | 377/8 |
| 5,084,906 A | | 1/1992 | Reist | 377/8 |
| 5,324,921 A | * | 6/1994 | Takarada et al. | 377/8 |

* cited by examiner

*Primary Examiner*—Tuan T. Lam
(74) *Attorney, Agent, or Firm*—Alston & Bird LLP

(57) ABSTRACT

A counting device associated with a conveying device for conveying flexible flat objects, such as printed products, in an overlapping stream. The counting device includes a slide mounted for forward and return movement along a guide which extends in the conveying direction, and a drive is provided for moving the slide along the guide at a higher speed than the conveying speed. The slide mounts a flexible contact element which engages the objects, and a sensor element which is engaged by the contact element when the contact element is deflected by engagement with a rear edge of each object, as the slide is forwardly advanced. A catch element, which is also mounted to the slide, then comes into contact with the rear edge of the object to displace the object in the conveying direction.

13 Claims, 3 Drawing Sheets

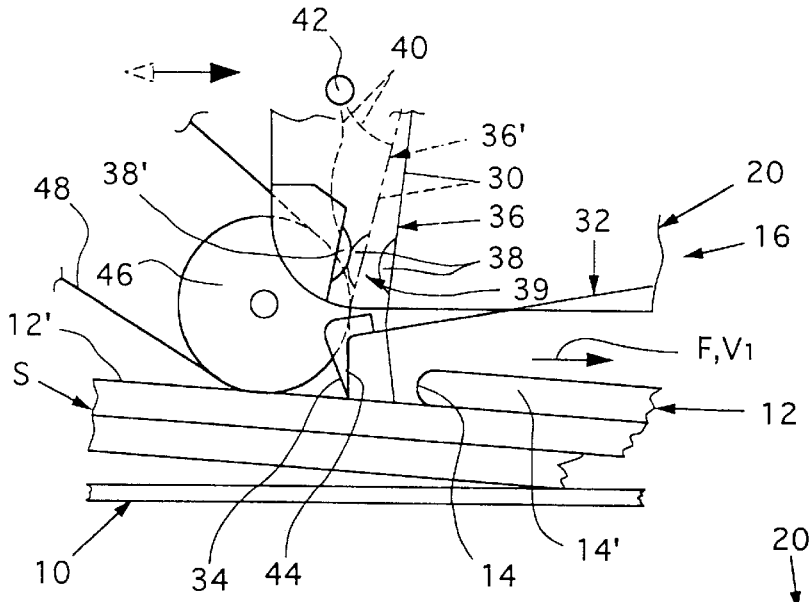
Fig.3
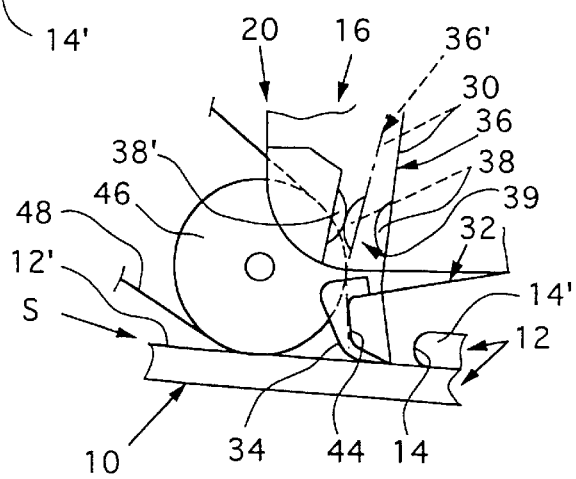
Fig.4
Fig.7
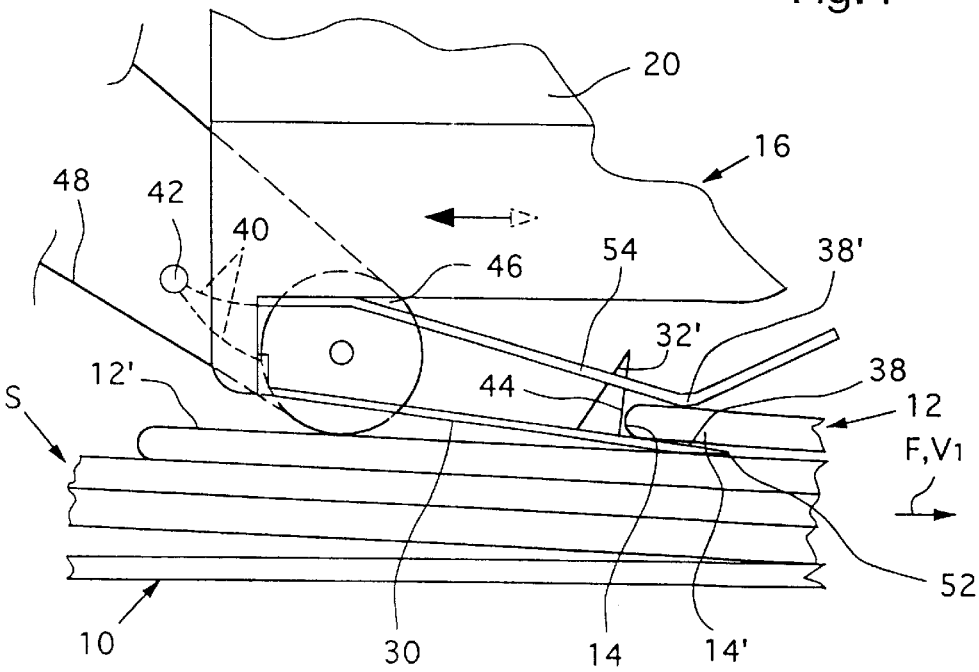

DEVICE FOR COUNTING OBJECTS CONVEYED IN AN OVERLAPPING ARRANGEMENT

BACKGROUND OF THE INVENTION

The present invention relates to an apparatus for counting flexible flat objects arranged in an overlapping formation, in particular printed products.

An apparatus of this type is disclosed by EP-A-0 408 490. A conveying device which is driven at conveying speed in the conveying direction and constructed as a belt conveyor is intended to convey objects in an overlapping formation, in which each object rests on the preceding one, in a system cycle rate. Arranged underneath the conveying device is a counting device, having a guide means which extends in the conveying direction and on which a slide is freely displaceably mounted. The slide can be moved to and fro, in and counter to the conveying direction, coordinated with the system cycle rate by means of a drive, the speed in the conveying direction, at least in one section of the guide means, being higher than the conveying speed, in order to bring a contact element arranged on the slide into contact with the rear edge of the object respectively moved past the counting device. The relative movement between the object and the slide causes the contact element to move out of the conveying area and, as a result, to activate a sensor element in order to emit a signal to a counter. In order to avoid the contact element exerting any influence on the position of the relevant object in any case, a pressure element is provided which presses the objects against the conveyor belt so that they are carried along firmly. In order to permit the counting of objects which are conveyed at irregular time intervals, coarse detection of the objects is performed and, accordingly, the contact element is activated at irregular time intervals.

It is an object of the present invention to provide a generic apparatus which, with a simple construction, ensures precise counting even of objects which occur at irregular intervals.

SUMMARY OF THE INVENTION

The above and other objects and advantages of the present invention are achieved by the provision of a conveying device which is driven at a conveying speed in a conveying direction and which is intended to convey the objects. A counting device includes a contact element and a sensor element mounted for movement along a guide which extends in the conveying direction, and a drive is provided for moving the elements along the guide at a higher speed than the conveying speed so as to bring the contact element into engagement with a rear region of each object conveyed past the counting device. The contact element then is deflected into engagement with the sensor element which emits a signal to a counter.

The object in each case interacting with a contact element is displaced in the conveying direction by means of a catch element driven together with the contact element. As a result, each object, even if the objects occur in an irregular overlapping formation, can interact only once with the contact element, which leads to extremely precise counting in a very simple way. The movement of the contact and catch element therefore does not need to be coordinated with a system cycle rate, the only condition is that the frequency with which these elements are moved cyclically in the conveying direction is at least as high as the maximum frequency with which the objects can occur. Even counting printed products with a prefold does not present any problems. The information about the time and the location at the end of the displacement by means of the catch element also means that the precise position of the object on the conveying device is known, which may be important for further processing. The apparatus is most suitable to process overlapping formations, in which the objects in each case rest on the preceding or in each case on the following object.

BRIEF DESCRIPTION OF THE DRAWINGS

The invention will be described in more detail using exemplary embodiments illustrated in the drawing, in which, in purely schematic form:

FIG. 3 shows, in a side view and enlarged with respect to FIG. 1, part of the apparatus shown there;

FIG. 4 shows, in an identical illustration to FIG. 3, the apparatus with a catch element of different design;

FIG. 7 shows, on an enlarged scale with respect to FIG. 6, a part of the apparatus shown there.

DETAILED DESCRIPTION OF THE PREFERRED EMBODIMENTS

Figure 1:
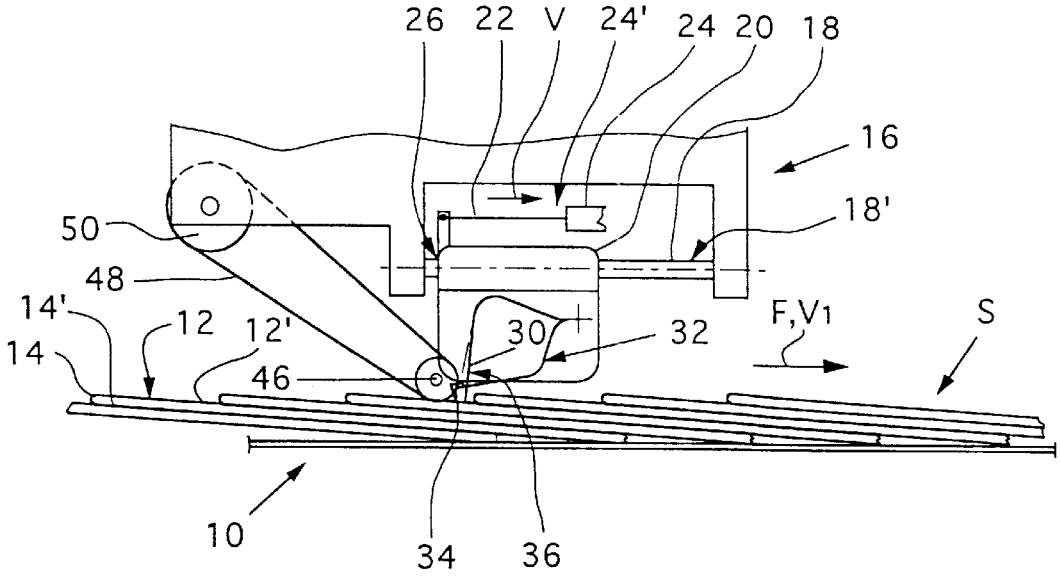
FIG. 1 shows a side view of a first embodiment of the apparatus at a time at which a slide belonging to the counting device is located with a contact and a catch element in an initial, upstream position.
Figure 2:
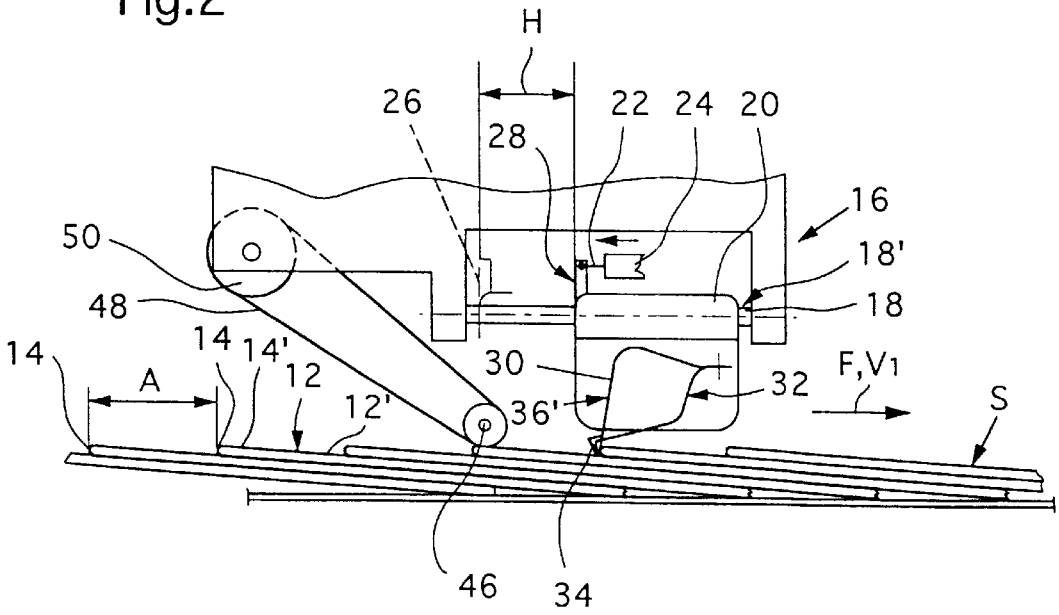
FIG. 2 shows, in an identical illustration to FIG. 1, the apparatus shown there with the slide in a final, downstream position.

The apparatus shown in FIGS. 1 to 3 has a conveying device 10 designed as a belt conveyor, which is driven at the conveying speed $v_1$ in the conveying direction F. It is intended to convey flexible flat objects 12, for example thin printed products, in an overlapping formation S, in which each object 12 rests on the one respectively following it. The rear edge 14, located in the rear end region 14' of the object 12, is therefor exposed in the upward direction. In the overlapping formation S shown, the objects 12 are arranged in such a way that the distance the rear edges 14 of successive objects corresponds to a permissible minimum distance A. The distance between the rear edges 14 is, however, usually greater than this minimum distance A and, in particular, it can vary greatly in the case of an irregular overlapping formation.

Arranged above the conveying device 10 is a counting device 16. It has a guide rail 18' which extends n the conveying direction F and forms a guide means 18. A slide 20 is freely moveably mounted on said guide rail. It is connected via a rod 22 to a drive 24' constructed as a cylinder/piston unit 24. The drive 24' is intended to move the slide 20 from an initial, upstream position 26, indicated by continuous lines in FIG. 1 and by dashed lines in FIG. 2, in the conveying direction F into a final, downstream position 28, indicated with continuous lines in FIG. 2, and back again in a cyclic manner. The stroke H of this movement is smaller than the permissible minimum distance A between the rear edges 14 of successive articles 12. The speed v at which the slide 20 is moved in the conveying direction F is, at least in one section of the guide means 18, higher than the conveying speed $v_1$. In the present case, the cylinder/piston unit 24 is controlled in such a way that, in both directions of motion, it accelerates to the speed v in a short acceleration section, moves with an approximately constant speed v in the abovementioned section and, in a subsequent retardation section, which in turn is very short as compared with the abovementioned section, brakes to a standstill.

The frequency f with which the slide 20 is moved to and fro by means of the drive 24' is at least equally as high as the maximum frequency at which the objects 12 can occur, which is given by the quotient of the conveying speed $v_1$ and the permissible minimum distance A. The frequency f is advantageously approximately 1.2 to 4 times as high as the frequency defined by this ratio.

Fixed to the slide 20 at its one end is a bow-shaped contact element 30 of self-sprung design. Its free end extends approximately perpendicular to the conveying plane determined by the conveying device 10. With the end region on this side, it projects forward, beyond the slide 20, in the direction counter to the conveying direction 10 and is intended to rest and to slide with the free end on that flat side 12' of the objects 12 which faces the counting device 16, under a low spring prestress.

Also fixed to the slide 20, at its one end, is a catch element 32, which is likewise of self-sprung design and shaped like a bow. In its free end region, it has a hook element 34, which is intended likewise to rest with its free end under spring prestress on the flat side 12' of the objects 12 and to slide along the latter. As FIGS. 1 and 3 reveal, when it is in its rest position 36, the contact element 30 extends forward in the conveying direction F with respect to the hook element 34. In the contact position, which is indicated by dash-dotted lines in FIG. 2 and in FIG. 3, the contact element 30, as viewed in the conveying direction, is located close to the catch element 32 and rests with a contact piece 38 fixed to it on a mating contact piece 38' fixed to the slide 20. The contact piece 38 and the mating contact piece 38', forming a sensor element 39, are connected via lines 40 to a counter 42. Because the objects 20 are caught by the catch element 32, the contact element 30 does not have to move back away in the direction of the conveying device 10.

In the embodiment of the hook element 34 shown in FIG. 3, its catch face 44 is designed to be flat, while in the embodiment illustrated in FIG. 4, the catch face 44 of the hook element 34 is curved, so that the free end region of the hook element 34, as viewed in the conveying direction F, pointing forward, can engage underneath the relevant object 12, in each case from the rear edge 14, and thus lift it into the hook element 34. In the rest position 36, the contact element 30 is located—in the conveying direction—close to the tip of the catch element 32, in the contact position 36 at the bottom of the hook.

A reference roll 46 is freely rotatably mounted so as to be fixed in relation to the guide rail 18'. Led around said roll is a belt 48, which runs further around a roll 50 which, in relation to the reference roll 46, is arranged upstream and at a greater distance than the reference roll 46 from the conveying device 10. Together with the conveying device 10, the belt 48 forms an inlet for the overlapping formation S and prevents objects 12 being carried along by friction when an object 12 is gripped by the hook element 34 and displaced in the conveying direction F. For this purpose, the reference roll 46 is arranged upstream, at a short distance from the catch element 32 in the initial position 26'.

Figure 5:
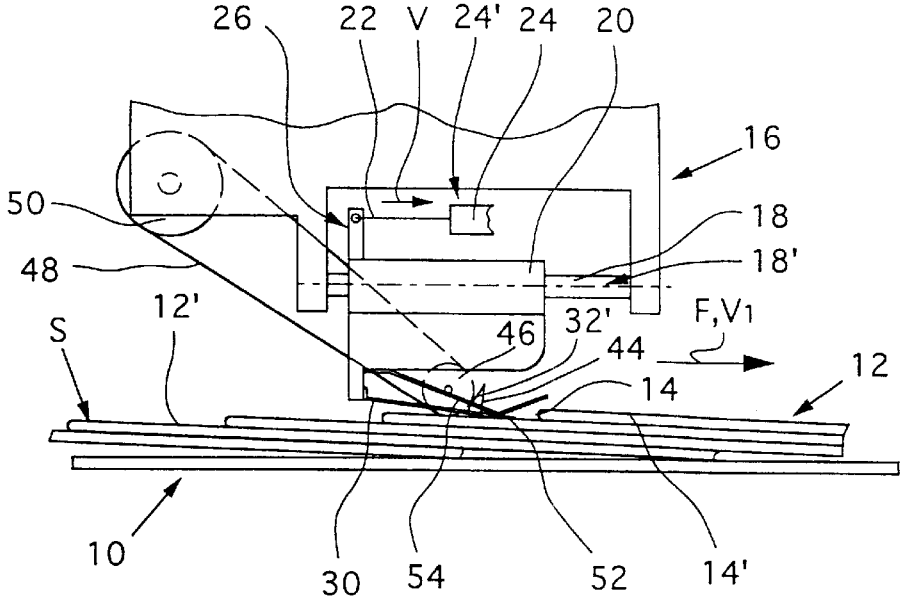
FIG. 5 shows a side view of a second embodiment of the apparatus according to the invention with the slide in the initial, upstream position.
Figure 6:
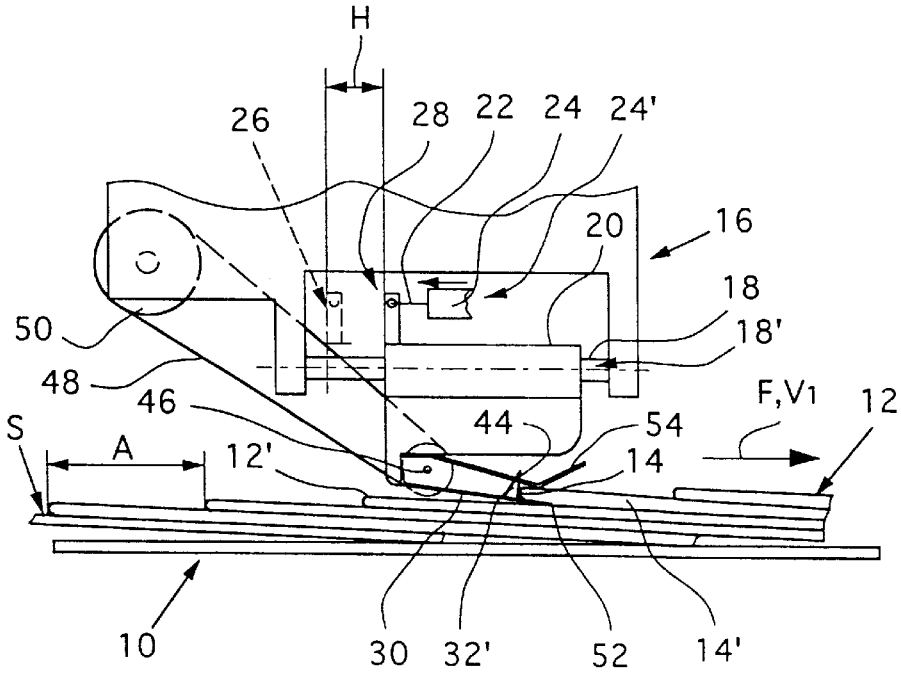
FIG. 6 shows, in an identical illustration to FIG. 5, the apparatus shown there with the slide in the final, downstream position.

In the embodiment shown in FIGS. 5 to 7 as well, the conveying device 10 is constructed as a belt conveyor and is intended to convey the objects 12 in an overlapping formation S, in which each object 12 rests on the one respectively following, at the conveying speed $v_1$ in the conveying direction F. Located above the conveying device 10 is the counting device 16, with the guide rail 18' forming the guide means 18. The slide 20 mounted on said guide rail is connected via the rod 22 to the piston/cylinder unit 24 which, as drive 24', drives the slide 24 in exactly the same way as described further above in connection with the embodiment shown in FIGS. 1 to 4.

The contact element 30 is fixed to the slide 20. It is designed as a spring tongue, which is oriented with its free insertion end 52 in the conveying direction F and is intended to rest under spring prestress on the flat side 12' of the objects 12 and to slide along the latter. On that side of the contact element 30 facing away from the conveying device 10, a sensor element 54 is arranged. It is likewise designed like a spring tongue, fixed with the upstream end to the slide 20 and bent over in its downstream end region. In the region of the bent-over portion, the sensor element 54 rests on the contact element 30 and, together with the end region of the contact element on the insertion end, forms an inlet for the rear edge 14 of the objects 12. The sensor element 54 is lifted by the contact element 30 when the contact element 30 is inserted into the object 12 or between two objects 12 and, in so doing, engaging under parts of the object 12 or the preceding object 12 in the end region 14' of the latter, as shown by FIGS. 6 and 7. The contact element 30 forms an electric contact piece 38, which interacts with the mating contact piece 38' formed by the sensor element 54. The contact element 30 and the sensor element 54 are likewise connected via lines 40 to a counter 42.

Upstream of the bent-over portion of the sensor element 54, a catch element 32' is fixed directly to the contact element 30, projects from the contact element 30 like a tongue in the direction of the slide and projects beyond the sensor element 54. It is intended for its catch face 44 to come into contact with the rear edge 14 of an object 12 located between the contact element 30 and sensor element 54, and to displace said object in the conveying direction F.

The apparatus functions as follows. The slide is driven, by means of the drive 24', in and counter to the conveying direction F at a higher frequency F than the objects 12 occur. At the same time, in the case of the embodiments shown in FIGS. 1 to 4, the hook element 34 of the catch element 32 and the free end of the contact element 30, which is in the rest position 36, and, in the case of the embodiment shown in FIGS. 5 to 7, the contact element 30, slide along the flat side 12' of an object 12. Because of the relative movement between the object 12 conveyed in the conveying direction F and the slide 20 moved counter to the conveying direction F, the hook element 34 and contact element 30 run off the object 12 at its rear edge 14 and come to rest on the flat side 12' of the following object 12. During the next stroke of the slide 20 in the conveying direction F, the slide 20 catches up with the relevant object 12 again and, in the case of the embodiment shown in FIGS. 1 to 4, the contact element moves away from the rear edge 14 of the object into the contact position 36' and, in the case of the embodiment shown in FIGS. 5 to 7, the sensor element 54 is lifted off the contact element 30. The signal produced at this time can be evaluated by the counter 42 for the purpose of counting. Then, during the further movement of the slide 20 in the conveying direction F, the catch element 32, 32' takes the relevant object 12 with it. At the end of its working stroke, the slide 20 is braked, the object 12 then being conveyed onward at the conveying speed $v_1$ by the conveying device 10, and the electric contact being opened again in the case of the embodiment shown in FIGS. 1 to 4, and closed in the case of the embodiment shown in FIGS. 5 to 7. This signal is also suitable to be evaluated by the counter 42. In particular, with knowledge of the corresponding position of the slide 20 at a specific time, the precise location of the object 12 can be determined, which may be important for further processing.

This procedure is repeated for each object. Each object is displaced out of the active range of the counting device 16 and can therefore influence the counter only once.

The embodiment of the hook element 34 shown in FIG. 4 has the advantage over the embodiment shown in FIG. 3 of preventing a situation in which only the hook element 34 but not the contact element 30 can run off an object 12 since, as viewed in the conveying direction F, the free end of the hook element 34 and of the contact element 30 are arranged at the same level.

It is also conceivable, in an embodiment of the contact element 30 according to FIGS. 5 to 7, to provide the contact element 30 with a reflector at its free end and to construct the sensor element as a light-source/light-sensor element, which can be arranged on the slide 20 or in a stationary position at the downstream end position 28 of the reflector.

The apparatus is also suitable for counting objects which arise in an overlapping formation in which each object rests on the preceding one. To this end, the counting device is arranged in mirror-image form to the embodiments shown, underneath the conveying device F, in such a way that the contact element and catch element project beyond the conveying plane.

What is claimed is:

1. An apparatus for counting flexible flat objects arranged in an overlapping formation, comprising a conveying device which is driven at a conveying speed in a conveying direction and intended to convey the objects, a counting device having a contact element and a sensor element interacting therewith, a guide means extending at least approximately in the conveying direction for mounting the contact element, and having a drive which moves the contact element, in at least one section of the guide means, in the conveying direction at a higher speed than the conveying speed and brings said contact element into interaction with a rear region of each object conveyed past the counting device, the sensor element configured for emitting a signal to a counter when the contact element interacts with an object, and a catch element which is moved together with the contact element by means of the drive and is intended to come into contact with the rear edge of the object respectively interacting with the contact element and to displace said object in the conveying direction.

2. The apparatus as claimed in claim 1, wherein the catch element is arranged on the contact element.

3. The apparatus as claimed in claim 1, wherein the contact element, when in a rest position, is arranged so as to extend forward in the conveying direction in relation to the catch element, and is forced back resiliently by the respective object, counter to the conveying direction, as far as the catch element and so as to cause the sensor element to emit a signal to the counter.

4. The apparatus as claimed in claim 1, further comprising a slide which is guided on the guide means, and which is connected to the drive and on which the contact element and the catch element are arranged.

5. The apparatus as claimed in claim 1, further comprising a slide which is guided on the guide means, and which is connected to the drive and on which the contact element is fixed.

6. The apparatus as claimed in claim 1, wherein the contact element is of resilient and tongue-like design, and is oriented with its free insertion end in the conveying direction and is configured to be inserted in the conveying direction into the object or between two successive objects.

7. The apparatus as claimed in claim 1, wherein the frequency with which the contact element and catch element are driven is at least equal to the quotient of the conveying speed and a permissible minimum distance between the rear edges of successive objects.

8. The apparatus as claimed in claim 6, wherein the sensor element comprises a spring tongue which is configured to normally rest on the contact element and be lifted from the contact element when the contact element interacts with an object during movement of the slide in the conveying direction.

9. The apparatus as claimed in claim 8, wherein the contact element and the sensor element have electrical contacts which are closed when the sensor element rests upon the contact element to form part of an electrical circuit leading to the counter.

10. The apparatus as defined in claim 9, wherein the catch element is fixed on the contact element.

11. An apparatus for counting flexible flat objects arranged in an overlapping formation, comprising a conveying device which is driven at a conveying speed in a conveying direction and intended to convey the objects, and a counting device mounted on one side of the conveying device and including a guide rail extending parallel to the conveying direction, a slide mounted for movement along the guide rail, a drive for cyclically moving the slide along the guide rail in and counter to the conveying direction, a sensor element mounted to the slide, a flexible contact element mounted to the slide and extending to a position to rest upon the objects being conveyed by the conveying device, and such that during the movement of the slide in the conveying direction the contact element is deflected into contact with the sensor element by engagement with a rear region of each object conveyed past the counting device and so that the sensor element emits a signal to a counter, and a catch element mounted to the slide which is configured to come into contact with a rear edge of an object which is engaged by the contact element to displace the object in the conveying direction as the slide continues to move in the conveying direction.

12. The apparatus as claimed in claim 11 wherein the speed of movement of the slide in the conveying direction is greater than said conveying speed of said conveying device during at least a portion of the movement of the slide.

13. The apparatus as claimed in claim 12, wherein the stroke of the slide is less than the permissible minimum distance between the rear edges of successive objects.

* * * * *